US008118995B2

(12) United States Patent
King et al.

(10) Patent No.: US 8,118,995 B2
(45) Date of Patent: Feb. 21, 2012

(54) PROCESS FOR INHIBITING FOULING IN HYDROCARBON PROCESSING

(75) Inventors: Mary King, Kingwood, TX (US); Cato Russell McDaniel, The Woodlands, TX (US)

(73) Assignee: General Electric Company, Schenectady, NY (US)

( * ) Notice: Subject to any disclaimer, the term of this patent is extended or adjusted under 35 U.S.C. 154(b) by 430 days.

(21) Appl. No.: 12/415,373

(22) Filed: Mar. 31, 2009

(65) Prior Publication Data

US 2010/0243537 A1 Sep. 30, 2010

(51) Int. Cl.
*C10G 9/16* (2006.01)

(52) U.S. Cl. ..... 208/48 AA; 208/46; 208/47; 208/48 R; 208/289; 585/2; 585/950; 570/103; 570/222; 570/262; 203/6; 203/7; 203/8; 203/9

(58) Field of Classification Search ..... 203/6, 7, 203/8, 9; 208/48 AA, 46, 47, 48 R, 289; 570/103, 222, 262; 585/2, 950
See application file for complete search history.

(56) References Cited

U.S. PATENT DOCUMENTS

| | | | | |
|---|---|---|---|---|
| 3,793,187 | A | 2/1974 | Marx et al. | |
| 4,673,489 | A | 6/1987 | Roling | |
| 4,952,301 | A | 8/1990 | Awbrey | |
| 5,264,114 | A | 11/1993 | Dunbar | |
| 5,620,567 | A | 4/1997 | Seidel et al. | |
| 5,650,072 | A * | 7/1997 | Mc Clain et al. | 210/698 |
| 5,770,041 | A | 6/1998 | Lewis et al. | |
| 6,986,839 | B2 | 1/2006 | Subramaniyam et al. | |
| 7,255,929 | B2 | 8/2007 | Turnquist et al. | |
| 2005/0147579 | A1 * | 7/2005 | Schneider et al. | 424/78.09 |

FOREIGN PATENT DOCUMENTS

EP 0824142 A2 2/1998

OTHER PUBLICATIONS

International Search Report issued in connection with corresponding PCT Application No. PCT/US2010/025155 on Jun. 21, 2010.

* cited by examiner

*Primary Examiner* — Prem C Singh
(74) *Attorney, Agent, or Firm* — GE Global Patent Operation; Catherine J. Winter

(57) ABSTRACT

A method for inhibiting the formation of fouling materials including contacting hydrocarbon media containing aldehyde compounds with an antifoulant while treating the hydrocarbon media with a basic wash. The antifoulant includes a reducing sugar.

20 Claims, 1 Drawing Sheet

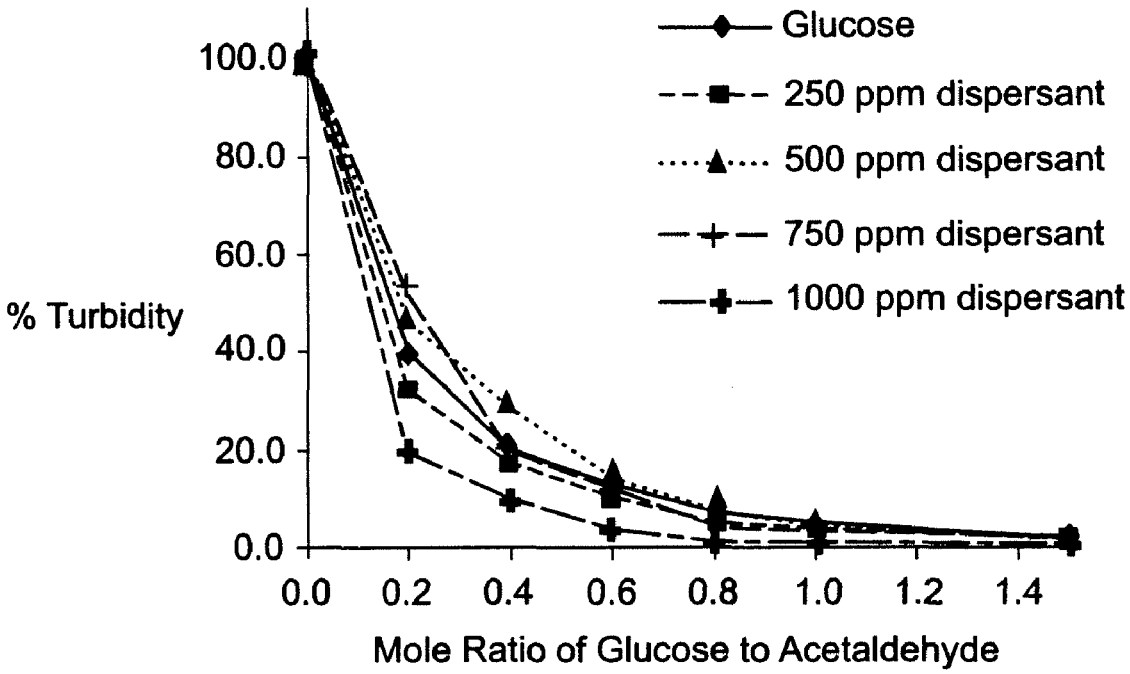
Glucose
250 ppm dispersant
500 ppm dispersant
750 ppm dispersant
1000 ppm dispersant
% Turbidity
100.0
80.0
60.0
40.0
20.0
0.0
0.0
0.2
0.4
0.6
0.8
1.0
1.2
1.4
Mole Ratio of Glucose to Acetaldehyde

PROCESS FOR INHIBITING FOULING IN HYDROCARBON PROCESSING

FIELD OF THE INVENTION

This invention relates to methods for reducing fouling in hydrocarbon processing and more particularly, to reducing aldol polymer fouling in hydrocarbon processing.

BACKGROUND OF THE INVENTION

Olefin compounds, such as ethylene, propylene, butylene and amylene, can be formed from pyrolytic cracking of light petrochemicals. During the cracking process, secondary reactions may also occur producing aldehydes. As a result, the cracked hydrocarbon product stream can also contain significant quantities of aldehydes.

The cracked hydrocarbon product stream is cooled to remove most of the heavier hydrocarbons and is then compressed. When the cracked hydrocarbon stream is passed through a basic wash to remove acidic compounds, such as carbon dioxide and hydrogen sulfide, the aldehydes will undergo polymerization to form condensation polymers known as aldol polymers or red oil. Aldol polymers are essentially insoluble in the alkaline wash and the hydrocarbon media and can deposit on the internal surfaces of process equipment. These deposits can restrict flow through the equipment, which causes the pressure drop to increase across the treating vessel, resulting in a loss of capacity and increased operating costs. If left untreated, the deposition from the fouling components can result in the premature shutdown of a cracking operation.

Many of the additives available for treating petrochemical processes for removing aldehydes are not environmentally friendly. For example, additives containing nitrogen can contaminate wastewater streams requiring treatment before discharge.

What is needed is an effective and environmentally friendly treatment for reducing fouling and minimizing the deposition of fouling compounds during the basic wash stage of petrochemicals processing.

SUMMARY OF THE INVENTION

In one embodiment, a method for inhibiting the formation of fouling materials including contacting hydrocarbon media containing aldehyde compounds with an antifoulant while treating the hydrocarbon media with a basic wash, wherein said antifoulant includes a reducing sugar.

The various embodiments provide improved methods for reducing harmful aldol formation and inhibiting fouling in petrochemical processing. The methods are non-toxic, non-hazardous and environmentally safe.

BRIEF DESCRIPTION OF DRAWING

FIG. 1 is a graph showing the turbidity response of a reducing sugar and varying amounts of a dispersant. The graph is mole ratio of glucose to acetaldehyde vs. % turbidity.

DETAILED DESCRIPTION OF THE INVENTION

The singular forms "a," "an" and "the" include plural referents unless the context clearly dictates otherwise. The endpoints of all ranges reciting the same characteristic are independently combinable and inclusive of the recited endpoint. All references are incorporated herein by reference.

The modifier "about" used in connection with a quantity is inclusive of the stated value and has the meaning dictated by the context (e.g., includes the tolerance ranges associated with measurement of the particular quantity).

"Optional" or "optionally" means that the subsequently described event or circumstance may or may not occur, or that the subsequently identified material may or may not be present, and that the description includes instances where the event or circumstance occurs or where the material is present, and instances where the event or circumstance does not occur or the material is not present.

In one embodiment, a method for inhibiting the formation of fouling materials including contacting hydrocarbon media containing aldehyde compounds with an antifoulant while treating the hydrocarbon media with a basic wash, wherein said antifoulant includes a reducing sugar.

The antifoulant includes a reducing sugar. It is believed that the reducing sugar competes with aldehydes in undergoing aldol condensation reactions in the basic wash. The products formed from the condensation reactions have a multiplicity of hydroxyl groups and are soluble in the basic wash and can be removed with the basic wash. The reducing sugar and the compounds formed are not harmful to the environment, to the hydrocarbon media or to the processing equipment.

The reducing sugar may be any type of compound having a reducing sugar moiety that is soluble in or compatible with the basic wash. In one embodiment, the reducing sugar may be a saccharide containing an aldehyde group and having an anomeric carbon in the free form or open chain configuration in which the anomeric carbon is not locked in an acetal or ketal linkage. In another embodiment, the reducing sugar may be an aldose saccharide. In another embodiment, the reducing sugar may be a ketose sugar having a ketone group, which can isomerize to an aldose in the open chain form. The saccharides may include monosaccharides, disaccharides or oligosaccharides and may or may not have one or more hydroxyl groups removed, replaced or modified, provided that at least one anomeric carbon is free in the open chain configuration. There are many reducing sugars and any reducing sugar may be used. In one embodiment, the reducing sugar includes, but is not limited to, glucose, glucosamine, acetyl glucosamine, fructose, lactose, galactose, mannose, maltose, ribose, xylose, lyxose, rhamnose, cellobiose, arabinose or blends thereof. In one embodiment, the reducing sugar may be a blend of reducing sugars. In another embodiment, the reducing sugar may be a blend of glucose and fructose. In one embodiment, the reducing sugar may be a blend or syrup of reducing sugars derived from the hydrolysis of saccharides, such as disaccharides or higher saccharides.

The antifoulant is present in any amount effective for reducing aldol fouling. In one embodiment, an excess may be added. In another embodiment, the antifoulant is used in a mole ratio of the antifoulant to aldehyde compounds in an amount of from about 0.1:1 to about 10:1. In another embodiment, the antifoulant is added in a mole ratio of the antifoulant to aldehyde compounds in an amount of from about 0.4:1 to about 5:1. In another embodiment, a mole ratio of the antifoulant to aldehyde compounds of at least 1:1 is added. In another embodiment, the mole ratio of antifoulant to aldehyde compounds is from about 1:1 to about 10:1. In another embodiment, the antifoulant is present in a mole ratio of the antifoulant to aldehyde compounds of from about 1:1 to about 3:1. In another embodiment, the mole ratio of antifoulant to aldehyde compounds is about 1:1.

In one embodiment, the antifoulant may be in solution form. In another embodiment, the antifoulant is in an aqueous solution. In one embodiment, the antifoulant may be added to the hydrocarbon media simultaneously with the basic wash. In another embodiment, the antifoulant may be added to the basic wash before contacting the hydrocarbon media.

The hydrocarbon media may be any type of hydrocarbon media. In one embodiment, the hydrocarbon media may be a cracked hydrocarbon stream from the pyrolysis of hydrocarbons, such as petrochemicals. In one embodiment, the petrochemicals may be pyrolytically cracked at a temperature of up to about 1700° F. In another embodiment, the petrochemicals may be pyrolytically cracked at a temperature in the range of from about 1550° F. to about 1670° F. In one embodiment, the cracked hydrocarbon stream may be from the pyrolysis of ethane, propane, butane, naphtha or mixtures thereof. In another embodiment, the hydrocarbon media includes olefins. In another embodiment, the olefinic compounds include, but are not limited to, ethylene, propylene, butadiene, amylene or mixtures thereof.

The hydrocarbon media may contain any amount of aldehyde compounds and any amount of aldehyde compounds may be treated. In one embodiment, the concentration of aldehyde compounds in the hydrocarbon media will range from about 0.5 ppm to about 4000 ppm. In another embodiment, the aldehyde compounds are present in the hydrocarbon media in an amount of from about 1 ppm to about 1000 ppm. In another embodiment, the aldehyde compounds are present in the hydrocarbon media in an amount of from about 3 ppm to about 500 ppm.

The hydrocarbon media is treated with a basic wash. The basic wash may be any alkaline wash having a pH of greater than 7.0. In one embodiment, the basic wash is a caustic wash. In another embodiment, the basic wash includes, but is not limited to, sodium hydroxide, potassium hydroxide or alkanolamines.

The hydrocarbon media may be washed by any suitable method or means for contacting the hydrocarbon media with a basic solution. In one embodiment, the basic wash may be in an alkaline scrubber. In another embodiment, the hydrocarbon media may be contacted with a basic wash in trayed or packed columns utilizing any of the various types of packing elements; or spray type contactors. The mode of flow within a basic wash can be either cross-flow or countercurrent flow, or both.

In one embodiment, a caustic stream may be introduced into an upper portion of a caustic wash system and the hydrocarbon media may be introduced into a lower portion. The caustic introduced into the caustic wash system flows downwardly through the vessel while the hydrocarbon media flows upwardly through the caustic wash system, whereby the hydrocarbon media is intimately contacted with the caustic stream.

In another embodiment, additives may be added with the antifoulant. In one embodiment, the additives may be dispersants, surfactants, anti-foams, corrosion inhibitors, oxygen scavengers, anti-oxidants, metal deactivators or anti-polymerants. In one embodiment, a dispersant may be added. In another embodiment, the dispersant may be a naphthalene sulfonate. In one embodiment, the dispersant may be added in an amount of from about 10 ppm to about 10,000 ppm. In another embodiment, the dispersant may be added in an amount of from about 100 ppm to about 1000 ppm.

In order that those skilled in the art will be better able to practice the present disclosure, the following examples are given by way of illustration and not by way of limitation.

EXAMPLES

Example 1

Stock solutions of various sugars in deionized water were prepared in concentrations ranging from 0.25M (cellobiose), 0.5M (acetylglucosamine), 1.0M (glucosamine, rhamnose) to 2.0M (glucose, maltose, fructose, sucrose, xylose, arabinose, lyxose, ribose). A set of eight samples for each sugar was prepared by adding aliquots of the Stock sugar solution such that the molar equivalent of sugar with respect to acetaldehyde in each sample bottle was 0, 0.2, 0.4, 0.6, 0.8, 1.0, 1.5, and 3.0, respectively.

A 16 mL aliquot of a 12.5% sodium hydroxide solution was added to each sample bottle. A stock sugar solution, as prepared above, was added to the sample bottle and a 0.10 mL of a 50% wt/wt Stock solution of acetaldehyde in deionized water was then added (for those sample sets using the more diluted Stock sugar solutions (i.e., <1M), a 13 mL aliquot of 15.4% NaOH solution was used instead of the 12.5% NaOH solution). The volume in the sample bottles was immediately adjusted to 20.0 mL using deionized water so that the final concentration of NaOH in each bottle was 10%.

The samples were shaken well and then incubated 24 hours in an oven set in a range from 40° C. to 50° C. The turbidity of each sample was measured in NTU using a Hach 2100N Turbidimeter. In order to compare the impact of the sugars on turbidity, the samples in each set were normalized against the blank sample containing 0 molar equivalents of sugar. The results are shown in Table 1.

TABLE 1

| Sample | MR[1] 0.0 (% T) | MR[1] 0.2 (% T) | MR[1] 0.4 (% T) | MR[1] 0.6 (% T) | MR[1] 0.8 (% T) | MR[1] 1.0 (% T) | MR[1] 1.5 (% T) | MR[1] 3.0 (% T) |
|---|---|---|---|---|---|---|---|---|
| CE-1 Sucrose | 100.0 | 101.5 | 104.5 | 104.4 | 106.1 | 103.7 | 109.1 | 114.1 |
| 1 Glucose | 100.0 | 32.9 | 16.3 | 9.0 | 5.9 | 4.6 | 1.8 | 0.6 |
| 2 Ribose | 100.0 | 20.7 | 6.5 | 2.2 | 0.9 | 0.4 | 0.2 | 0.1 |
| 3 Arabinose | 100.0 | 22.5 | 6.2 | 2.6 | 1.1 | 0.6 | 0.3 | 0.1 |
| 4 Xylose | 100.0 | 21.3 | 7.5 | 3.4 | 1.9 | 1.0 | 0.4 | 0.1 |
| 5 Lyxose | 100.0 | 24.3 | 7.4 | 3.2 | 1.5 | 0.9 | 0.4 | 0.1 |
| 6 Rhamnose | 100.0 | 14.8 | 7.9 | 6.0 | 5.1 | 3.1 | 1.8 | 0.9 |
| 7 Maltose | 100.0 | 19.2 | 7.9 | 4.5 | 3.6 | 2.2 | 1.0 | 0.5 |
| 8 Cellobiose | 100.0 | 18.3 | 5.0 | 3.9 | 2.5 | 1.5 | 0.7 | N/A |
| 9 Glucosamine | 100.0 | 19.9 | 3.3 | 1.1 | 0.6 | 0.4 | 0.2 | 0.1 |
| 10 Acetyl Glucosamine | 100.0 | 48.6 | 26.1 | 18.7 | 13.8 | 12.0 | 7.6 | 4.1 |
| 11 Fructose | 100.0 | 29.5 | 12.2 | 4.9 | 2.7 | 1.1 | 0.2 | 0.1 |

[1]MR = Mole ratio (sugar:aldehyde)

The % Turbidity improves (decreases) with the addition of reducing sugars showing that insoluble products are decreasing. The turbidity also improves with increasing mole ratio of reducing sugar to aldehyde compounds. The turbidity does not improve with the addition of a non-reducing sugar, sucrose (CE-1).

Example 2

From a 2.0 M Stock solution of glucose, five sample sets were prepared such that each set consisted of nine samples containing 0, 0.2, 0.4, 0.6, 0.8, 1.0, 1.5, 3.0, and 5.0 molar equivalents each of glucose with respect to acetaldehyde. A 16 mL aliquot of a 12.5% sodium hydroxide solution was added to each sample bottle. A stock sugar solution was added to each sample bottle and a 0.10 mL of a 50% wt/wt Stock solution of acetaldehyde in deionized water.

A Stock solution consisting of 10% wt/wt naphthalene sulphonated polymer dispersant in deionized water was prepared using DAXAD® 14C from Hampshire Chemical Corp. All of the sample bottles in one set were dosed with 0.05 mL of the DAXAD® 14C Stock solution. All of the sample bottles in the second set were dosed with 0.10 mL of the DAXAD® 14C Stock solution. All of the sample bottles in the third set were dosed with 0.15 mL of the DAXAD® 14C Stock solution, and all of the sample bottles in the fourth set were dosed with 0.20 mL of the DAXAD® 14C Stock solution. No DAXAD® 14C Stock solution was added to the fifth set of sample bottles. The volume in each of the sample bottles was adjusted to 20.0 mL using deionized water so that the final concentration of NaOH in each bottle was 10%.

The samples were shaken well and then incubated for 24 hours in an oven set at 40° C. The turbidity of each sample was measured in NTU using a Hach 2100N Turbidimeter. The samples in each set were normalized against the blank sample containing 0 molar equivalents of glucose. The results are shown in FIG. 1.

The dispersant does not significantly interfere with or improve the reducing sugar to remove turbidity. The dispersant has a slight affect on the turbidity only at very low levels of the reducing sugar.

While typical embodiments have been set forth for the purpose of illustration, the foregoing descriptions should not be deemed to be a limitation on the scope herein. Accordingly, various modifications, adaptations and alternatives may occur to one skilled in the art without departing from the spirit and scope herein.

The invention claimed is:

1. A method for inhibiting the formation of fouling materials comprising contacting hydrocarbon media containing aldehyde compounds with an antifoulant while treating the hydrocarbon media with a basic wash, wherein said antifoulant comprises a reducing sugar such that the molar equivalent of reducing sugar with respect to the aldehyde compound is 0.2 to 5.0.

2. The method of claim 1 wherein the reducing sugar is a saccharide containing an aldehyde group and having an anomeric carbon in an open chain configuration.

3. The method of claim 2, wherein the reducing sugar is an aldose saccharide.

4. The method of claim 1 wherein the reducing sugar is selected from the group consisting of glucose, glucosamine, acetyl glucosamine, fructose, galactose, lactose, mannose, maltose, ribose, xylose, lyxose, rhamnose, cellobiose and arabinose and blends thereof.

5. The method of claim 4, wherein the reducing sugar is a blend of glucose and fructose.

6. The method of claim 1, wherein the reducing sugar is derived from hydrolysis of a saccharide.

7. The method of claim 1 wherein a molar excess of the antifoulant contacts the hydrocarbon media.

8. The method of claim 1 wherein the antifoulant is added in a mole ratio of the antifoulant to aldehyde compounds in an amount of from about 0.1:1 to about 10:1.

9. The method of claim 8 wherein the antifoulant is added in a mole ratio of the antifoulant to aldehyde compounds in an amount of from about 0.4:1 to about 5:1.

10. The method of claim 1 wherein the antifoulant is in an aqueous solution.

11. The method of claim 1 wherein the antifoulant is added to the hydrocarbon media simultaneously with the basic wash.

12. The method of claim 1 wherein the antifoulant is added to the basic wash before contacting the hydrocarbon media.

13. The method of claim 1 wherein the hydrocarbon media is a cracked hydrocarbon stream from the pyrolysis of hydrocarbons.

14. The method of claim 13 wherein the cracked hydrocarbon stream is from the pyrolysis of ethane, propane, butane, naphtha or mixtures thereof.

15. The method of claim 1 wherein the basic wash has a. pH greater than 7.0 and comprises sodium hydroxide, potassium hydroxide or alkanolamines.

16. The method of claim 1 further comprising the addition of an additive.

17. The method of claim 16 wherein the additive is added in an amount of from about 10 ppm to about 10,000 ppm.

18. The method of claim 17 wherein the additive is added in an amount of from about 100 ppm to about 1000 ppm.

19. The method of claim 16 wherein the additive is a dispersant.

20. The method of claim 19 wherein the dispersant is naphthalene sulfonate.

* * * * *